United States Patent [19]

Goto

[11] 4,022,566

[45] May 10, 1977

[54] GAS-FUELED ELECTRIC LIGHTER

[75] Inventor: Kenjiro Goto, Urawa, Japan

[73] Assignee: Mansei Kogyo Kabushiki Kaisha, Saitama, Japan

[22] Filed: Dec. 18, 1975

[21] Appl. No.: 641,814

[30] Foreign Application Priority Data

Dec. 19, 1974 Japan ..... 49-154140[U]

[52] U.S. Cl. ..... 431/132; 431/256

[51] Int. Cl.[2] ..... F23Q 2/08

[58] Field of Search ..... 431/255, 256, 257, 132; 317/85

[56] References Cited

UNITED STATES PATENTS

| | | | |
|---|---|---|---|
| 3,369,157 | 2/1968 | Remy | 431/256 X |
| 3,583,849 | 6/1971 | Liesse | 431/255 |
| 3,584,247 | 6/1971 | Pietzonka | 431/255 X |
| 3,824,072 | 7/1974 | Makino | 431/255 |

*Primary Examiner*—Edward G. Favors

*Attorney, Agent, or Firm*—Oblon, Fisher, Spivak, McClelland & Maier

[57] ABSTRACT

A gas-fueled electric lighter includes a high voltage generating circuit for generating a sparking energy sufficient to ignite a fuel issued from a fuel outlet valve, a pair of switching contacts each of which is electrically connected to each terminal of the high voltage generating circuit, and first and second actuators for controlling movement of the switching contacts relative to each other to effect operation of the high voltage generating circuit.

25 Claims, 17 Drawing Figures

GAS-FUELED ELECTRIC LIGHTER

BACKGROUND OF THE INVENTION

1. Field of the Invention

This invention relates to a gas-fueled electric lighter, and more particularly, to a lighter wherein an improved switching device is employed with a stable electrical connection for safely energizing an electric ignition circuit.

2. Description of the Prior Art:

Heretofore, in a gas-fueled electric lighter which has an electric ignition circuit with a spark gap, a switching operator is slidably or reciprocably provided on an outer surface of a lighter casing and is so constructed that the operator may actuate a switching device and a gas outlet valve by one series action. Such construction is, at a glance, convenient for use but it is very dangerous to keep the lighter, for example, in a user's pocket due to unexpected sparks and sequential fuel ignition under theoperation of the switching device incurred by a careless touch on the operator. Further, in such a conventional lighter, one of the contacts of the switching device is arranged on the operator and a lead from one pole of a power source is directly connected to the operator or a return spring of the operator by means of a solder. This connection, however, has the possibility of snapping the lead wire under the influence of percussion at the time of actuation of the operator. Also, because of the soldering process or the like, much time is required for the assembling of the relevant components. Further, the conventional lighter is provided with a flame opening which is always exposed to the atmosphere. This makes a switching operation more unstable because of the impossibility of preventing dust or another impurity from entering into the casing and from adhering to a contact point of the switching device.

SUMMARY OF THE INVENTION

The present invention contemplates the provision of an improved gas-fueled electric lighter for reliably maintaining the electrical connection of relevant components and for making the lighter safe while in the user's pocket while eliminating the disadvantages of the conventional lighter.

It is, therefore, a principal object of the present invention to provide an improved gas-fueled electric lighter to obviate the above-mentioned disadvantages.

It is another object of the present invention to provide an improved gas-fueled electric lighter whose switching device has a reliable electric connection for stable operation.

It is still another object of the present invention to provide an improved gas-fueled electric lighter which is convenient for use and safe to be kept in a user's pocket.

The foregoing and other objects are attained in accordance with one aspect of the present invention through the provision of a gas-fueled electric lighter comprising a casing, a fuel reservoir arranged within the casing, a burner valve with a fuel discharge nozzle mounted on the fuel reservoir to permit a gaseous fuel to issue therefrom, a valve control means adapted to open and close the burner valve, a spark gap arranged adjacent to the fuel discharge nozzle, a high voltage generating circuit for generating a sparking energy sufficient to ignite the fuel from the fuel discharge nozzle, a power supply source for energizing the high voltage generating circuit, first and second switching contacts electrically connected to a pair of terminals of the high voltage generating circuit to control the spark discharge at the spark gap, a first actuator for operating the first switching contact in relation to the second switching contact, the first and second switching contacts being arranged moveable relative to each other to effect operation of the high voltage generating circuit, and a second actuator arranged to control the movement of the second switching contact between its operative position where it can contact the first switching contact by way of the operation of the first actuator and its inoperative position where it is maintained not to contact the first switching contact. The first and second switching contacts are operated through the first and second actuators independently of each other at an optional time interval. The movement of the first switching contact may be effected in the horizontal direction relative to the lighter so that in case of normal use the flame extends above the lighter, while that of the second switching contact may be effected in the vertical direction. Preferably, the first actuator comprises a manual operator which is reciprocably arranged on the side wall of the casing so that the movement of the first switching contact is effected by the reciprocal movement of the manual operator.

One gas-fueled electric lighter according to the present invention includes a lighter lid arranged on the casing and an intermediary means moveably arranged between the lighter lid and the valve control means. The second acutator comprises the intermediary means and the movement of the second switching contact may be effected through the intermediary means in accordance with the operation of the lighter lid. The intermediary means includes a lid control means for facilitating the operation of the lid. The lid control means may pivotally move within the casing to define the operative and inoperative positions of the second switching contact under the operation of the lighter lid. In another lighter according to the present invention, the intermediary means is arranged to be slidable along a guiding pin which also slidably guides the valve control means. The intermediary means is linearly moveable within the casing to define the operative and inoperative positions of the second switching contact under the operation of the lighter lid. Preferably, the lighter lid is provided with a depending piece which has a curved edge to contact the intermediary means. The curved edge may define the movement of the intermediary means to determine the timing of the movement to the operative position of the second switching contact. In this way, the operative position of the second switching contact may be defined by the opened state of the lighter lid, while the inoperative position thereof may be defined by the closed state of the lighter lid.

Preferably, the first switching contact is disposed on the manual operator which is electrically connected to one terminal of the high voltage generating circuit and the second switching contact is disposed on the valve control means which is electrically connected to the other terminal of the high voltage generating circuit. It is also preferable that the manual operator be so constructed as not to be electrically connected at the inoperative position of the second switching contact to the valve control means. Such construction may be achieved, for example, by the provision of a depression or an electrically insulated member on the manual operator. In a preferred arrangement, the valve control means is slidably supported on a pin around which is arranged an electrically conductive spring means to bias the valve control means toward the operative position thereof. The valve control means may be electrically connected through the spring means to the other terminal of the high voltage generating circuit. An electrically conductive means may be arranged adjacent to the pin and in electric connection with the other terminal of the high voltage generating circuit. Additionally, a cover member may be arranged on the pin and in electric connection with the valve control means. The conductive means may be immoveably fixed by the cover member in tight contact therewith thereby assuring a reliable electric connection between the valve control means and the other terminal of the high voltage generating circuit. Preferably, the spring means includes an elastic plate and a coiled spring, wherein the elastic plate has a first branch which abuts on the valve control means to bias the latter toward its operative position and a second branch which is in contact with the other terminal of the high voltage generating circuit, the coiled spring being arranged between the first and second branches of the elastic plate. The valve control means whose one end is supported on the pin may be engaged at the other end thereof with the burner valve to control the operation of the latter. The burner valve may be provided with the fuel discharge nozzle which is electrically insulated from the valve control means but is electrically connected to the secondary side of the high voltage generating circuit. An electrically conductive disc may be arranged on the nozzle and biased by a spring means, arranged around the nozzle, to assure a fixed contact relation with the nozzle.

In one form of a supporting member for the components of the high voltage generating circuit, an extending wall is provided on which are arranged a guide for reciprocal movement of the manual operator and a spring for biassing the manual operator to its inoperative position. The manual operator may be electrically connected through the spring means to one terminal of the high voltage generating circuit. Additionally, the fuel reservoir may have disposed thereon an electrically conductive means which has an elastic piece to contact the manual operator. The manual operator may also be electrically connected through the conductive means to one terminal of the high voltage generating circuit. The supporting member may also be provided with a downwardly extending wall on which is arranged a terminal plate connected to one terminal of the high voltage generating circuit. An electrically conductive elastic means may be arranged in opposition to the terminal plate on the extending wall so as to hold the power supply source therebetween so that the elastic means is electrically connected through the spring means on the extending wall to the manual operator. Preferably, the elastic means is provided with an elastic contact piece to contact one pole of the supply source and with a biassing spring arranged behind the contact piece to bias the latter against the one pole of the supply source. Further, a bottom plate of the casing is provided with an opening for inserting and removing therethrough the supply source and with a detachable cap for shutting the opening. The detachable cap has arranged therein a horizontal recess in which a moveable plate is arranged for setting the detachable cap on the adjacent side wall of the casing. The movement of the plate may be effected through the tapered portion or the eccentric cam shaft of a plate actuating pin which is arranged on the detachable cap to extend through the moveable plate.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 3:
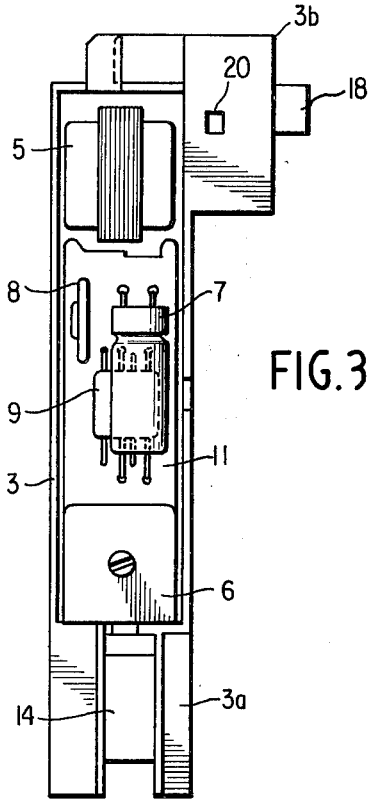
FIG. 3 is a longitudinal view showing an arrangement of components of a high voltage generating circuit.
Figure 4:
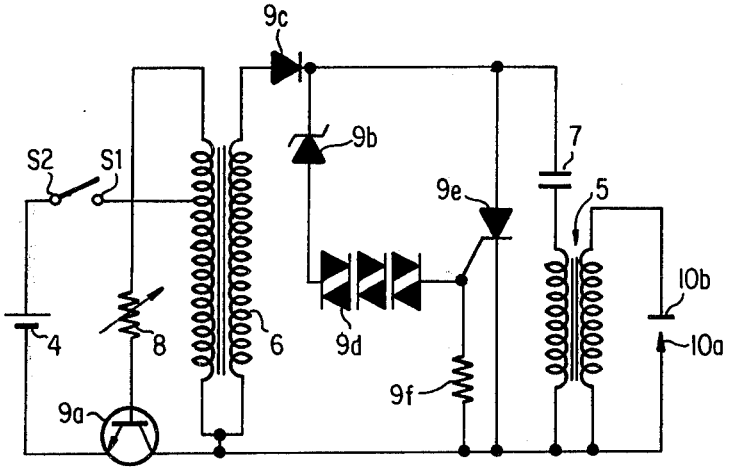
FIG. 4 is a schematic diagram of an electric circuit which may be employed in the present invention.
Figure 5:
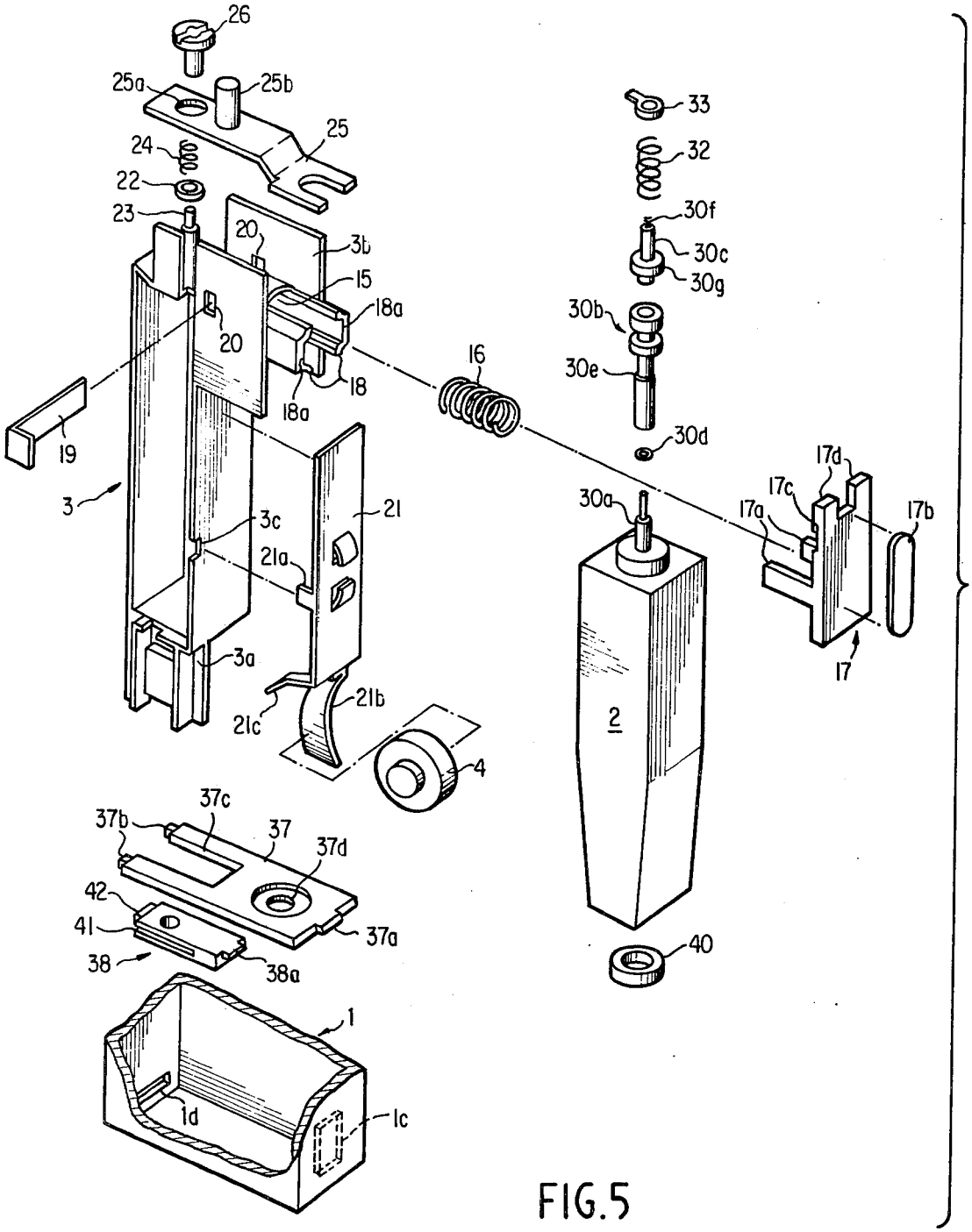

Referring now to the drawings, wherein like reference numerals designate identical or corresponding parts throughout the several views, and more particularly to FIGS. 1–12 thereof, one preferred embodiment of the present invention and partial modifications thereof are illustrated as applied to a gas-fueled electric lighter wherein a casing 1 of electrically conductive material has juxtaposingly arranged therein a fuel reservoir 2 and a housing 3 for a high voltage generating circuit. A battery 4 is arranged under the housing 3 as an electricity supplying source. The high voltage generating circuit comprises a step-up transformer 5, an oscillating transformer 6, a condenser 7, a variable registor 8, and an integrated circuit device 9 which consists of a transistor 9*a*, a Zener diode 9*b*, a diode a*c*, series diacs 9*d*, a thyristor 9*e* and a resistor 9*f*. These components are connected to each other as shown in FIG. 4 and constitute an ignition circuit together with the battery 4 and a pair of sparking electrodes 10*a* and 10*b* which are arranged at the secondary side of the high voltage generating circuit. The high voltage generating circuit is adapted to supply sparking energy to the pair of electrodes 10*a* and 10*b* at the time of operation. A base plate 11 has mounted thereon the oscillating transformer 6, the condenser 7, the variable resistor 8 and the integrated circuit device 9. The base plate 11 is fixedly secured on the inner wall of the housing 3 by pouring a thermosetting resin into the housing 3 and onto the circuit components. The step-up transformer 5 is also potted into the thermosetting resin within the housing 3 so that components of the high voltage generating circuit may be installed as a unit in the casing 1. From the top of the housing 3 are led out a pair of leads 12*a* and 12*b* which are electrically connected to the sparking electrodes 10*a* and 10*b*. In the primary side of the high voltage generating circuit are arranged a pair of terminals 13*a* and 13*b*, one of which is also led out from the top of the housing 3, while the other terminal is led out from the bottom of the housing 3. These terminals 13*a* and 13*b* (hereinafter referred to respectively as the first and the second terminals) are electrically connected to a switching device as described later. The housing 3 has a downwardly extending wall 3*a* for supporting the battery 4 when the latter is installed within the casing 1. On the extending wall 3*a* is arranged a terminal plate 14 which is connected at one side thereof with the second terminal 13*b* of the high voltage generating circuit and at the other side thereof with the negative pole of the battery 4. At the upper part of the housing 3, there is provided a pair of laterally extending walls 3*b* between which is provided a recess 15 for arranging therein a coiled metallic spring 16 (hereinafter, referred to as a return spring). The return spring 16 is in electrical contact with a manual operator 17 of electrically conductive material and biasses the latter to its normal inoperative position. A guide 18 is provided on the opposed insides of the extending walls 3*b*. The manual operator 17 is horizontally reciprocable along the guide 18 which has a pair of grooves 18*a* formed so as to correspond in shape to a pair of inner extending legs 17*a* of the operator 17. The distance between the inner surfaces of the grooves 18*a* is substantially equal to the inside diameter of the recess 15 so that the tip ends of the legs 17*a* of the operator 17 reliably contact one end of the return spring 16. The reciprocal movement of the manual operator 17 may be limited by abutment of the legs 17*a* thereof therough the return spring 16 against the side wall of the housing 3. An electrically conductive plate 19 is positioned on the bottom of the recess 15 to contact the other end of the return spring 16. A slit 20 is arranged in communication with the recess 15 on each of the laterally extending walls 3*b*. Each end of the conductive plate 19 passes through the slit 20 to abut the internal surface of the casing 1. In this construction, the mutual electrical connection between the manual operator 17, the return spring 16 and the conductive plate 19 may be constantly maintained without being influenced by movement of the manual operator 17. A thumb piece 17*b* of the operator 17 is arranged in a side opening 1*b* of the casing 1 and the external surface thereof is substantially flush with the external surface of the casing 1. If desired, the thumb piece 17*b* may be situated slightly inside from the external surface of the casing 1. This is quite effective to prevent the inadvertent operation of the manual operator 17.

Figure 7:
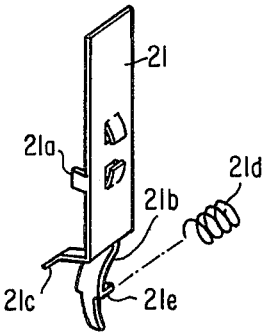

The lower edges of the laterally extending walls 3*b* abut the top surface of the fuel reservoir 2 to regulate the upward displacement of the latter. An elastic plate 21 of electrically conductive material is arranged between the housing 3 and the reservoir 2 to regulate the horizontal displacement of these two members. The elastic plate 21 is electrically connected through the casing 1 to the conductive plate 19. At the side edge of the elastic plate 21 is provided a projection 21*a* adapted to engage a concave portion 3*c* on the side wall of the housing 3. The lowr side of the elastic plate 21 has a first arc-shaped elastic plate 21*b* with a second inwardly bent elastic piece 21*c*. The first elastic piece 21*b* abuts the positive pole of the battery 4 and resiliently holds the battery 4 against the extending wall 3*a* of the housing 3 under the influence of its elasticity. As seen in FIG. 7, behind the first elastic piece 21*b* may be arranged a coiled spring 21*d* which is held at one side thereof by a pair of turned pieces 21*e* and which at the other side thereof abuts the inner surface of the casing 1. The spring 21*d* serves to bias the first elastic piece 21*b* toward the battery 4 assuring a more stable abutment between them. The second elastic piece 21*c* abuts the peripheral side of the battery 4 to regulate the travelling of the latter.

As is apparent from the discription set forth heretofore, the manual operator 17 is electrically connected to the second terminal 13*b* of the high voltage generating circuit through the terminal plate 14, the battery 4, the elastic plate 21, the casing 1, the conductive plate 19 and through the return spring 16.

Figure 8:
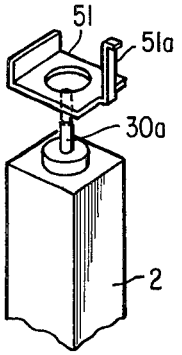

As shown in FIG. 8, on the fuel reservoir 2 is disposed an electrically conductive member 51 which has an upwardly extending elastic piece 51*a* in resilient contact with the inner wall of the manual operator 17. This conductive member 51 also serves to assure the electrical connection of the manual operator 17 to the second terminal 13*b* of the high voltage generating circuit. In this case, the electrical connection is achieved through the fuel reservoir 2, the elastic plate 21, the battery 4 and through the terminal plate 14.

Figure 9:
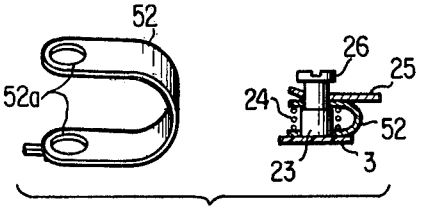

The first terminal 13*a* of the high voltage generating circuit is connected to an electrically conductive ring 22 by way of soldering. The ring 22 is maintained immoveable through a pin 23 which is integrally arranged on the top surface of the housing 3. Around the pin 23 is arranged an electrically conductive coiled spring 24 which biasses the ring 22 towards the top surface of the housing 3. A valve control plate 25 engages the pin through an opening 25*a* thereof and resiliently contacts the coiled spring 24 so that the valve control plate 25 may vertically move along the pin 23 under the upward biassing force of the spring 24. The upward movement of the valve control plate 25 is limited by a flanged head of a covering screw 26 which is in threaded engagement with the pin 23. The valve control plate 25 is made of electrically conductive material and is electrically connected to the first terminal 13*a* of the high voltage generating circuit through the ring 22 and the spring 24. In FIG. 9, there is shown a U-shaped metallic elastic plate 52 which is resiliently fixed on the pin 23 through a pair of openings 52*a* arranged on each branch thereof. The upper branch of the elastic plate 52 abuts the under surface of the valve control plate 25 to bias the latter upwards. The lower branch of the elastic plate 52 is disposed on the top surface of the housing 3 and is in contact at its end with the first terminal 13*a* of the high voltage generating circuit. Thus, the valve control plate 25 is electrically connected through the elastic plate 52 to the first terminal 13*a* of the high voltage generating circuit. The coiled spring 24 is arranged between the upper and lower branches of the elastic plate 52 thereby maintaining the tight contact between the relevant members.

Figure 10:
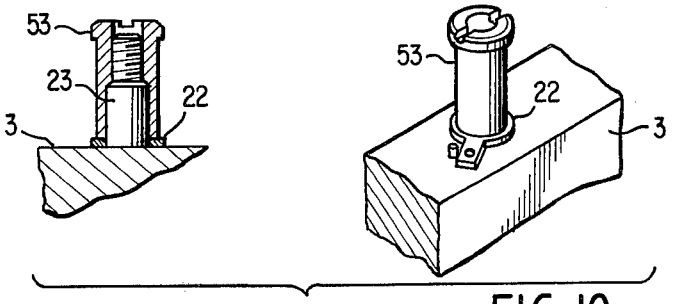

As seen in FIG. 10, a hollow covering screw 53 of electrically conductive material is arranged in electrical connection with the valve control plate 25 on the pin 23 to cover in threaded engagement therewith the full length of the pin 23. The conductive ring 22 is fixedly secured on the top surface of the housing 3 by the covering screw 53 so as to reliably maintain the electrical connection between the valve control plate 25 and the first terminal 13*a* of the high voltage generating circuit.

In the electrical ignition circuit, the primary side thereof is opened only between the manual operator 17 and the valve control plate 25. The switching device of the ignition circuit comprises a first switching contact S1 disposed in the front end of the valve control plate 25 and a second switching contact S2 disposed in the internal surface of the manual operator 17. Thus, each movement of the first and second switching contacts S1 and S2 corresponds to and is defined by each movement of the valve control plate 25 and of the manual operator 17 so that the movements of the switching contacts S1 and S2 may be effected independently of each other at an optional time interval. On the internal surface of the manual operator 17 there is provided a groove 17*c* which prevents, in spite of movement of the manual operator 17, the first and second switching contacts S1 and S2 from coming into contact with each other in an inoperative state of the lighter where the first switching contact S1 is in its inoperative position. On the internal surface of the manual operator 17 is also provided a projection 17*d* to be brought into contact with the first switching contact S1 in the operative position of the latter.

The valve control plate 25 is provided at the center portion thereof with an upwardly extending projection 25*b* of electric insulation on which abuts a cylinder 27 comprising a pair of telescopically connected cylindrical members between which is received a coiled spring (not shown). The cylinder 27 is engaged at one end thereof with a depending piece 28*a* on the internal surface of a pivotal lid 28 and at the other end thereof with a projected portion 29*a* of a support frame 29 serving as a pivot of the cylinder 27. The pivotal movement of the lid 28 is facilitated by the movement of the cylinder 27. The cylinder 27 normally depresses through the projection 25*b* the valve control plate 25 to its inoperative position and travels in accordance with the opening movement of the pivotal lid 28 to release the valve control plate 25 from depression thereof so that the valve control plate 25 may travel upwards into the operative position thereof under the influence of the spring 24. Thus, the upward and downward movement of the valve control plate 25 is effected through the cylinder 27 in accordance with the opening and the closing movement of the pivotal lid 28. In the operative position of the valve control plate 25 i.e. the first switching contact S1, it becomes possible to contact the projection 17*d* i.e. the second switching contact S2 on the manual operator 17.

On the fuel reservoir 2 is mounted a burner valve assembly which comprises a valve body 30*a*, a hollow cylindrical tube 30*b* of electrical insulation, an electrically conductive nozzle 30*c* and a nozzle cover 31 of electrical insulation. The valve body 30*a* is normally biassed upwards by a spring (not shown) arranged therein and is provided thereon with an elastic ring 30*d* for assuring a sealing connection with the tube 30*b*. The cylindrical tube 30*b* is provided on its periphery with a step 30*e* which the valve control plate 25 engages through the bifurcated portion thereof. The valve control plate 25 is electrically insulated through the tube 30*b* from the nozzle 30*c*. The nozzle 30*c* has arranged at the upper part thereof an electrically conductive coiled wire 30*f* for obtaining the optimum mixture of gaseous fuel with the air. The coiled wire 30*f* serves as the positive electrode 10*a* at a spark gap arranged in the secondary side of the high voltage generating circuit. On the periphery of the nozzle 30*c* is provided a flange 30*g* on which is arranged an electrically conductive coiled spring 32. A terminal disc 33 is arranged on the spring 32 and connected to the lead 12*a*. The spring 32 and the terminal disc 33 are resiliently held between the flange 30*g* and an enlarged top wall 31*a* of the nozzle cover 31 and are thereby maintained in reliable electrical connection with the nozzle 30*c*. The nozzle cover 31 is formed with the top wall 31*a* and a substantially hollow cylindrical wall 31*b*. The top wall 31*a* is provided at the center thereof with an opening 31*c* to permit the nozzle 30*c* to pass therethrough and at one side thereof with a vertical extension 31*d*. The extension 31*d* has a groove 31*e* for setting the lead 12*b* connected to the negative electrode 10*b*. The cylindrical wall 31*b* has arranged on the inner surface thereof a groove 31*f* for introducing the lead 12*a* connected to the positive electrode 10*a*.

Figure 11:
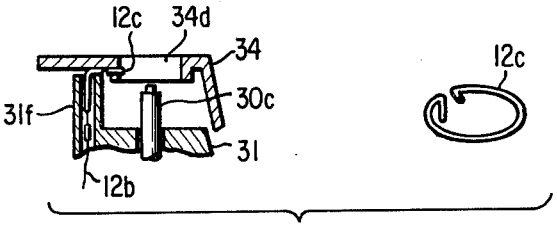

The supporting frame 29 is disposed at the rear side thereof on the upper edges of the extending walls 3*b* of the housing 3. A projection 29*b* on the front end of the frame 29 engages a corresponding depression 1*a* of the casing 1. On the beam portion of the frame 29 there are provided a hole 29*c* with a female thread therein and a groove 29*d* for introducing therethrough the lead 12*b* for the negative electrode 10*b*. An external cover 34 is fixedly mounted on the frame 29 by a screw 35 to be screwed into the hole 29*c* of the frame 29. An engaging portion 34*a* on the rear end of the cover 34 is received into a groove 50*a* provided on a bearing plate 50 for the pivotal lid 28. The nozzle cover 31 is disposed at the top wall 31*a* thereof on the frame 29 to be fixed between the latter and the external cover 34 so that the top wall 31*a* of the nozzle cover 31 may be engaged at each front corner thereof with a pair of bosses 34*b* on the inside wall of the external cover 34 and so that the edges of the top wall 31*a* may abut the inside wall of the cover 34. The lead 12*b* is immoveably set in the groove 31*e* of the vertical extension 31*d* by permitting the vertical extension 31*d* to abut the inside of the top wall of the external cover 34. The electrode 10*b* is directed to the coiled wire 30*f* on the nozzle 30*c* to form the spark gap therebetween. In FIG. 11, the tip end of the lead 12*b* is connected to an annular wire 12*c* of electrically conductive material which is provided with an end serving as the negative electrode 10*b* at the spark gap. The annular wire 12*c* is fixedly fitted around a flame opening 34*d* on the inner surface of the external cover 34 so that the electrode 10*b* may be maintained in an immoveable position. The external cover 34 is provided with an air opening 34*c* to exhaust unnecessary gas remaining within the cover 34 and to receive necessary air into the cover 34. In a concave portion 34*e* of the cover 34 there is provided a recess 34*f* with a bore for inserting therethrogh the screw 35 into the corresponding hole 29*c* of the frame 29. In such a way, the external cover 34 may be fixedly secured on the frame 29 thereby to be maintained in combined relation therewith. A screw cover 36 corresponds to and engages the concave portion 34*a* of the cover 34 to make flush the contour of the external cover 34.

Figure 1:
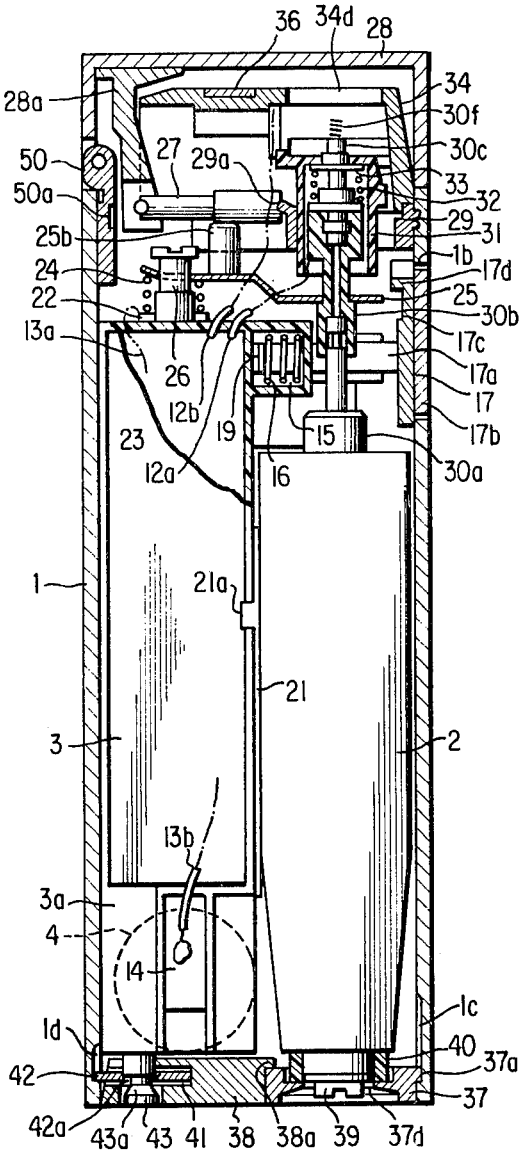
FIG. 1 is a longitudinal sectional view of a preferred embodiment according to the present invention showing a gas-fueled electric lighter.
Figure 2:
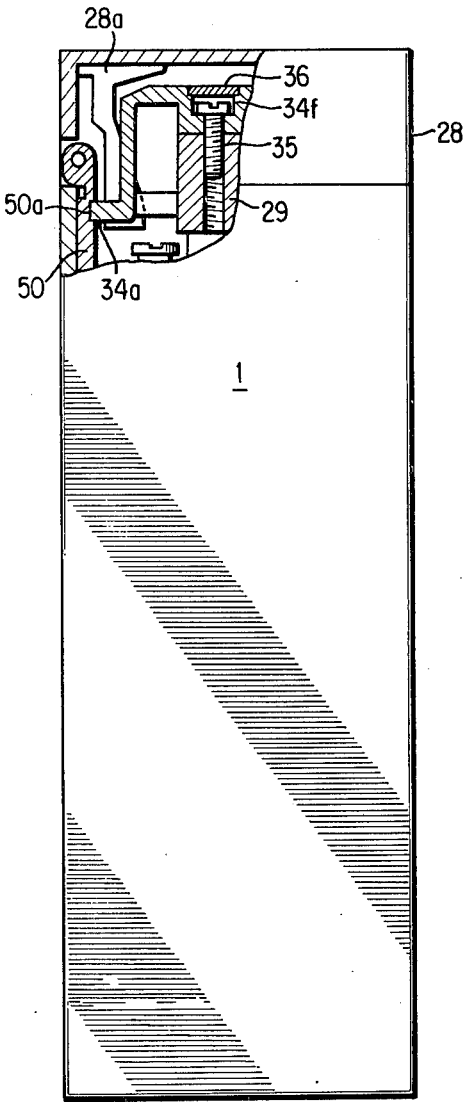
FIG. 2 is a longitudinal view partially in cutaway of the lighter shown in FIG. 1.
Figure 6:
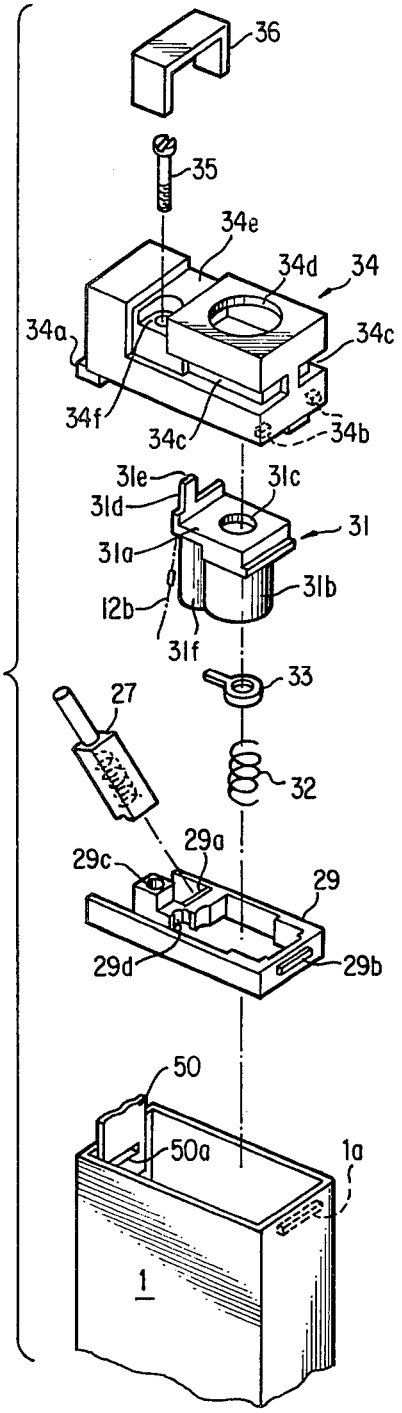
FIGS. 5 and 6 are exploded perspective views of parts of the lighter in FIG. 1, FIGS. 7 to 12 show partial modifications of the lighter components shown in FIG. 1.
Figure 12:
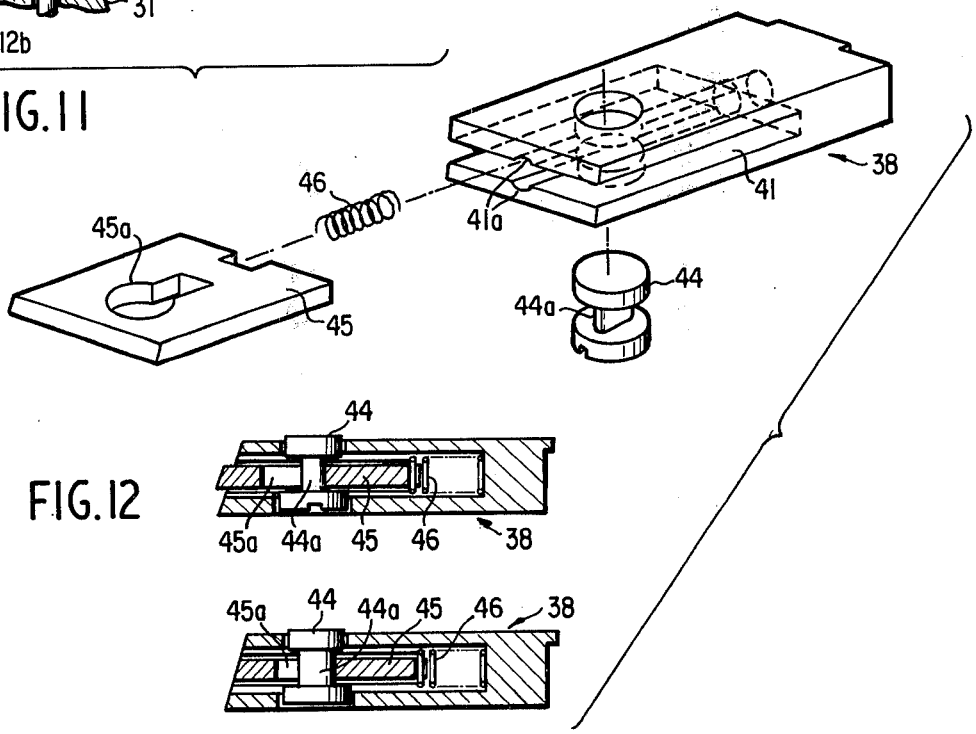
Figure 14:
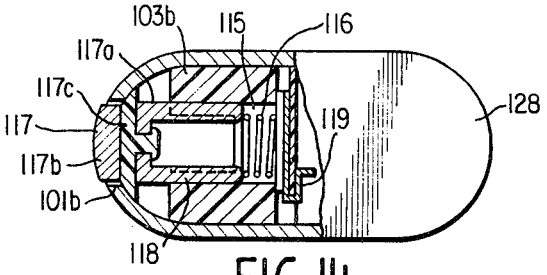
FIG. 14 is a top plan view in partial cutaway of the lighter in FIG. 13.
Figure 13:
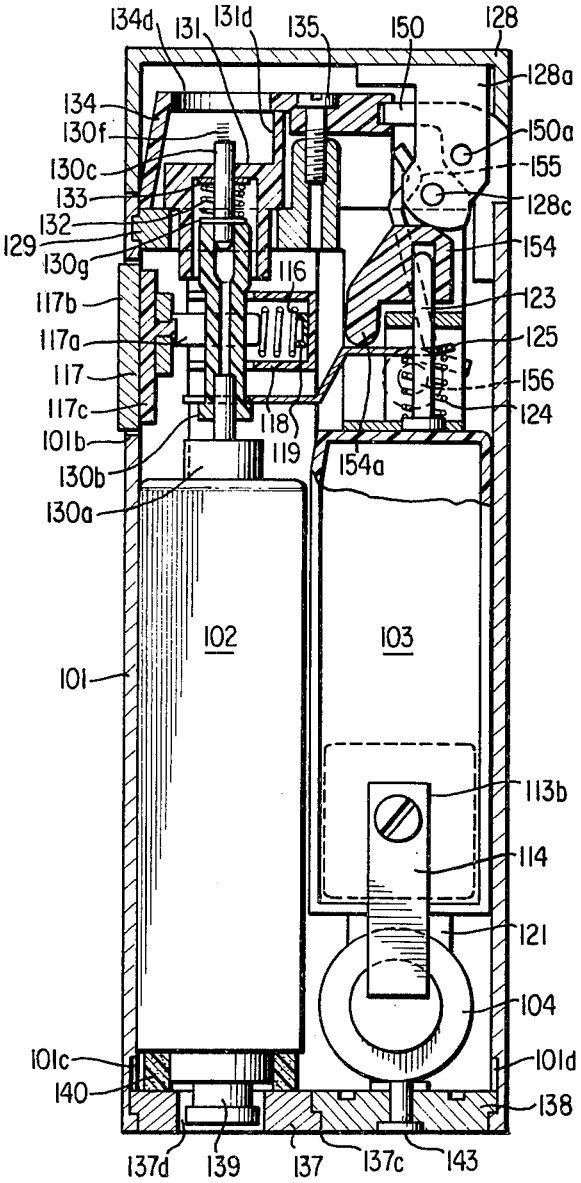
FIG. 13 is a longitudinal sectional view of a modified embodiment of a lighter according to the present invention.
Figure 15:
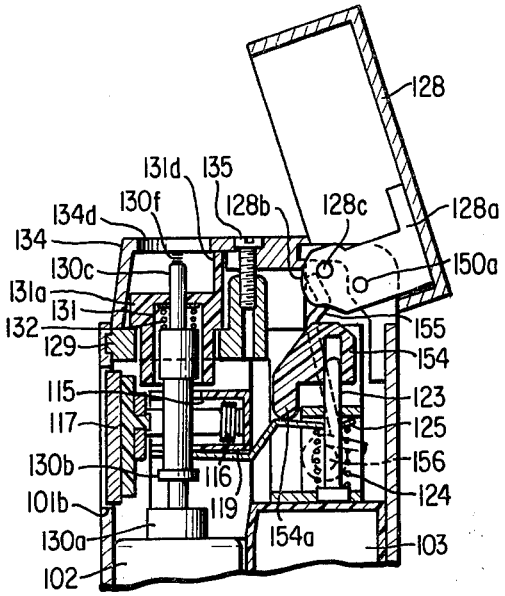
FIG. 15 is a fragmentary sectional view of the lighter in FIG. 13 shown in an operative position.
Figure 17:
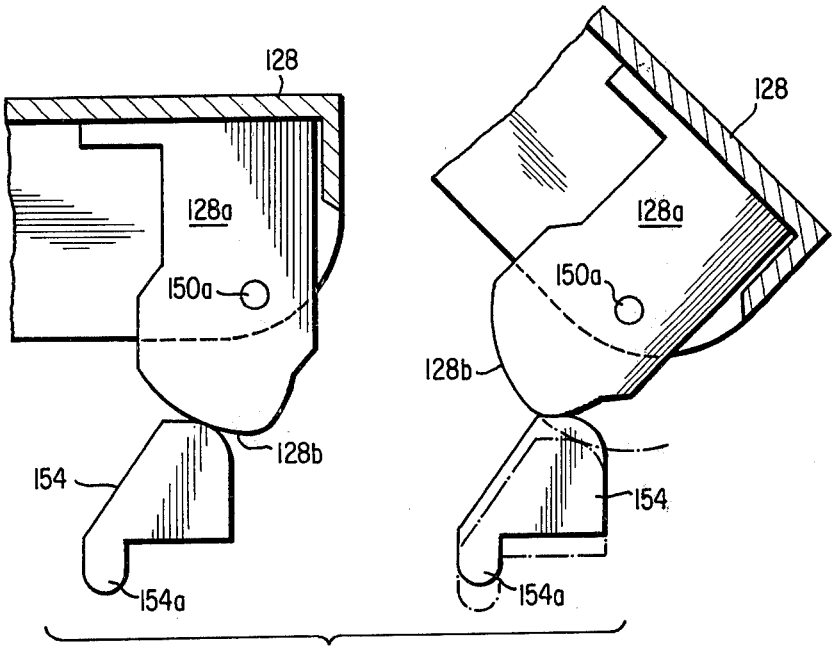
FIG. 17 is an enlarged schematic view showing the operative relation between a pivotal lid and an intermediary means.
Figure 16:
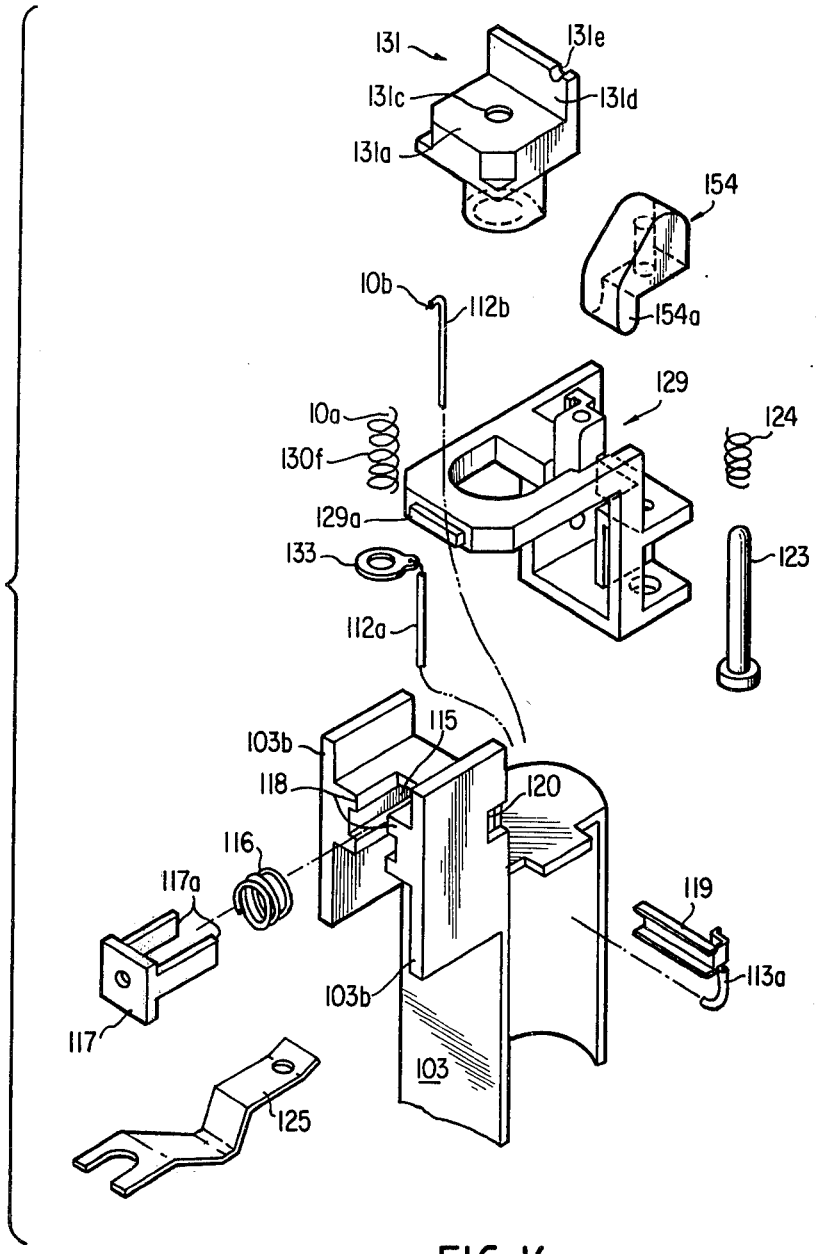
FIG. 16 is a schematical exploded perspective view of parts of the lighter shown in an enlarged scale.

A bottom plate 37 of the casing 1 has at one end thereof a projection 37*a* to be engaged with a depression 1*c* arranged at the front side wall of the casing 1 and at the other end thereof a pair of projections 37*b* to be engaged with a groove 1*d* at the rear side wall of the casing 1. On the rear side of the bottom plate 37 is provided a cut-out 37*c* for inserting and removing the battery 4 which is normally shut with a cap 38. On the front side of the bottom plate 37 is provided a circular opening 37*d* through which a fuel inlet valve 39 is exposed to the outside. A resilient circular ring 40 is arranged around the fuel inlet valve 39 and between the bottom plate 37 and the fuel reservoir 2 to bias these two members in opposite directions so as to assure the fixed arrangement. As seen in FIG. 1, the cap 38 is provided with a horizontal recess 41 within which is slidably arranged an elastic plate 42 with a protruded end. The protruded end of the elastic plate 42 engages the groove 1*d* of the casing 1 and a projected edge 38*a* of the cap 38 is disposed on the inner surface of the bottom plate 37 to thereby fix the cap 38 in position. The elastic plate 42 has arranged thereon an opening 42*a* through which a moveable pin 43 extends from the outer surface to inner surface of the cap 38. The circular edge of the opening 42*a* abuts the peripheral surface of the pin 43. The sliding movement of the elastic plate 42 is effected by a tapered portion 43*a* of the pin 43 so that when the pin is pushed inwardly the elastic plate 42 may move horizontally along the inclination of the tapered portion 43*a* so as to be disengaged from the groove 1*d* of the casing 1. In FIG. 12 showing a modified form of the cap construction, a rotatable pin 44 inserted into the cap 38 is formed with an eccentric cam shaft 44*a* which passes through an opening 45*a* of a sliding plate 45. The sliding plate 45 is biassed to the ajdacent side wall of the casing 1 by a spring 46 which is arranged in symmetrically opposed depressions 41*a* within the interior of the horizontal recess 41 of the cap 38 to allow one end of the plate 45 to enage the groove 1*c* of the casing 1. One part of the opening 45*a* abuts the eccentric cam shaft 44*a* under the effect of the spring 46. Upon rotation, of the pin 44, the plate 45 slides in projection to the eccentricity of the cam shaft 44*a* against the force of the spring 46 in the direction to be disengaged from the groove 1*d* of the casing 1.

When the pivotal lid 28 is operated, it pivots until a depending piece 28*a* comes into contact with the external cover 34. The cylinder pivots around the projected portion 29*a* toward the clock-wise direction in FIG. 1 to release the valve control plate 25 from the depression thereof. Then, the valve control plate 25 travels vertically to its operative position under the influence of the spring 24 so that the nozzle 30*c* may be moved upwards by the spring of the valve body 30*a* to permit a gaseous fuel to issue therefrom through the intermediary of a valve (not shown) which is opened simultaneously with vertical movement of the nozzle 30*c*. On the other hand, when the manual operator is pushed horizontally towards its operative position, it contacts the tip end of the valve control plate 25 to operate the electric ignition circuit. Thus, electric sparks are generated at the spark gap to ignite the gaseous fuel issued from the nozzle 30*c* to form a flame at the flame opening 34*d*. The sparks may be repeated at the predetermined period so long as the first switching contact S1 on the valve control plate 25 is in contact with the second switching contact S2 on the manual operator 17. When the pushing force is released, the manual operator 17 is returned to its initial inoperative position due to the return spring 16. In accordance with the closing movement of the pivotal lid 38, the cylinder 27 is returned to its initial position to depress the valve control plate 25 so that the valve control plate 25 may be returned to its initial inoperative position to close the valve.

FIGS. 13 to 17 show a modified form of the present invention wherein an electric ignition circuit and components of a high voltage generating circuit correspond to those of the first embodiment as shown in FIGS. 3 and 4. There are arranged in a casing 101 a fuel reservoir 102 and a housing 103 for a high voltage generating circuit. A battery 104 is arranged adjacent to the housing 103 at the lower part of the casing 101. The housing 103 is integrally provided with a pair of upwardly extending lateral walls 103*b* on the inside of which are integrally formed a recess 115 and symmetrically opposed grooves 118*a* which extend to a guide 118 for a horizontally moveable manual operator 117. Arranged within the recess 115 is a coiled spring 116 whose one end abuts a pair of legs 117*a* of the manual operator 117 to normally bias the latter to its inoperative position. On each of the lateral walls 103*b* is also provided a slit 120 into which an electrically conductive plate 119 is inserted to extend through the recess 115 from one to the other of the lateral walls 103*b*. The manual operator 117 has arranged therein an electrically insulated plate 117*c* of synthetic resin so as to be electrically insulated from the casing 101. A thumb piece 117*b* of the manual operator 117 is arranged in a side opening 101*b* of the casing 101 and projects slightly from the outer surface of the casing 101. The conductive plate 119 abuts the other end of the return spring 116 and is connected to a first terminal 113*a* of the high voltage generating circuit. On the lower part of the housing 103 is arranged a terminal plate 114 which is connected at one end thereof to the second terminal 113*b* of the high voltage generating circuit and at the other end thereof contacts the negative pole of the battery 104. The positive pole of the battery 104 contacts an elastic metal plate 121 held between the housing 103 and the inner surface of the casing 101. On the fuel reservoir 102 there is mounted a burner valve assembly which comprises a valve body 130*a*, an electrically insulated tube 130*b*, an electrically conductive nozzle 130*c* and a nozzle cover 131. The valve body 130*a* has disposed therein a spring (not shown) which normally biasses the body 130*a* to its open position. The tube 130*b* is tightly connected at the lower end thereof with the valve body 130*a* and at the upper part thereof with the nozzle 130*c*. A vertically movable valve control plate 125 is engaged at its front bifurcated end with the tube 130*b* for controlling the opening and closing movement of the burner valve. The nozzle 130*c* has mounted at the top thereof a coiled wire 130*f* serving as a positive electrode 10*a* at the spark gap. A flange 130*g* is provided at the periphery of the nozzle 130*c*. Arranged on the flange 130*g* is an electrically conductive coiled spring 132 which has mounted thereon a terminal disc 133 electrically connected to the secondary side of the high voltage generating circuit. The coiled spring 132 and the terminal disc 133 are resiliently held between the flange 130*g* and the nozzle cover 131 to maintain a reliable electric connection with the nozzle 130*c*. The nozzle 130*c* extends through an opening 131*c* of the nozzle cover 131 close by a flame opening 134*d* of a windshield 134 and is in opposition to a negative electrode 10*b* arranged at the flame opening 134*d* to form the spark gap therebetween. The nozzle cover 131 is mounted at an enlarged top wall 131*a* on a chassis 129 and is fixed so that a vertically extending wall 131*d* of the nozzle cover 131 may abut the top wall of the windshield 134. A lead 112*b* for the negative electrode 10*b* is engaged in a groove 131*e* of the vertical wall 131*d* to maintain it immoveable between the vertical wall 131*d* and the windshield 134. The windshield 134 is engaged at the rear end thereof with a fixing piece 150 on the upper part of the casing 101 and is fixedly secured on the chassis 129 by screw 135. A front projection 129*a* of the chassis 129 is engaged with a groove 101*a* of the casing 101. The chassis 129 has arranged on the rear part thereof a guiding pin 123 along which the valve control plate 125 is slidably guided. Around the guiding pin 123 is arranged an electrically conductive coiled spring 124 which contacts with the valve control plate 125 to bias the latter upwards to its operative position. The valve control plate 125 is electrically connected to the second terminal 113*b* of the high voltage generating circuit through the spring 124, the chassis 129, the casing 101, the battery 104 and the terminal plate 114. An intermediary control piece 154 is slidably disposed on the upper part of the guiding pin 123 and is provided with a lower extending portion 154*a* which abuts the valve control plate 125. A pivotal lid 128 is hinged on an axis 150*a* of the fixing piece 150 through a depending piece 128*a* thereof. A lower curved edge 128*b* of the depending piece 128*a* abuts the control piece 154 to depress the latter in the closed state of the pivotal lid 128. The curved edge 128*b* is formed with a part of an imaginary circle having its center on the axis 150*a*, so that, as far as the control piece 154 contacts the curved edge 128*b*, it may be kept immoveable in the depressed position thereof in spite of pivotal movement of the lid 128. Thus the curved edge defines the movement of the intermediary control piece 154 to determine the timing of movement to the operative position of the valve control plate 125. This is effective to prevent the issue of gaseous fuel beyond such amount as is necessary for ignition. When the control piece 154 is released from abutment of the curved edge 128*b* by way of sufficient pivotal movement of the lid 128, it may move upwards into its operative position together with the valve control plate 125 under the effect of the coiled spring 124 and of the spring arranged within the valve body 130*a*. Adjacent to the guiding pin 123 is arranged a lid control spring 155 whose one end is fixedly supported on a horizontal pin 156 arranged on the chasis 129 and whose other end abuts a roller around a pin 128*c* of the pivotal lid 128. The control spring 156 has a cranked portion through which the pivotal lid is biased to directions to facilitate the opening and closing movements of the lid 128.

In the circuit arrangement, a first switching contact S1 is disposed on the manual operator 117 and a second switching contact is disposed on the valve control plate 125. The second switching contact S2 is normally maintained in its inoperative position where it is prevented from electrical contact with the first swiching contact S1 because only the insulated plate 117*b* of the manual operator 117 is permitted to come into contact with the valve control plate 125 even if the operator 117 is actuated. Because of travel to its operative position due to the pivotal movement to the operative position of the lid 128, the second switching contact S2 can electrically contact the first switching contact S1. Thus, the operation of the first and second switching contacts S1 and S2 corresponds to and is defined by the operation of the manual operator 117 and of the valve control plate 125.

A bottom cover 137 of the casing 101 is provided with an opening 137*d* for fuel inlet valve 139 and with a cut-out 137*c* for inserting and removing therethrough the battery 104. A resilient circular ring 140 is arranged around the fuel inlet valve 139 between the fuel reservoir 102 and the bottom cover 137 for biassing these two members in opposite directions to assure the mutual fixation of inner components. The bottom cover 137 engages depressions 101*c* and 101*d* at each end thereof to be fixed in position. In the cut-out 137*c* of the bottom cover 137 is detachably arranged a battery cap 138, one end of which projects to engage the depression 101*d* of the casing 101 and the other end of which engages the edge of the cut-out 137*c*. A pin 143 is rotatably arranged in the battery cap 138 so that the cap 138 may be released from or reset onto the depression 101*d* through the rotation of the pin 143.

Upon movement of the pivotal lid 128 around the axis 150*a* the depending piece 128*a* is pivoted around the axis 150*a* such that the curved edge 128*b* slides on and along the upper surface of the intermediary control piece 154. Further movement of the pivotal lid 128 causes the control piece 154 to be released from the curved edge 128*b* so that the valve control plate 125 may vertically travel to its operative position together with the control piece 154 under the spring effect mentioned before. At the same time, the valve is opened and the gaseous fuel issues from the nozzle 130*c*. In the operative position of the valve control plate 125, the manual operator is pushed inwardly to its operative position so that the first switching contact S1 on the manual operator 117 may be brought into contact with the second switching contact S2 on the valve control plate 125. The switching device is turned on and the electric ignition circuit is operated to generate electric sparks at the spark gap. The spark ignites the gaseous fuel from the nozzle 130*c*. Upon releasing the pushing force, the manual operator 117 is detached from the valve control plate 125 and returned to its initial inoperative position due to the force of the spring 116. Thus, the switching device is turned off. In accordance with the closing movement of the pivotal lid 128, the curved edge 128*b* of the depending piece 128*a* abuts and depresses the control piece 154 to return the valve control plate 125 to its initial inoperative position. Simultaneously, the valve is closed to cease the issuance of gaseous fuel.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A gas-fueled electric lighter comprising a casing, a fuel reservoir arranged within the casing, a burner valve with a fuel discharge nozzle mounted on the fuel reservoir to permit a gaseous fuel to issue therefrom, a valve control means adapted to open and close the burner valve, a spark gap arranged adjacent to the fuel discharge nozzle, a high voltage generating circuit for generating a sparking energy sufficient to ignite the fuel from the fuel discharge nozzle, a power supply source for energizing the high voltage generating circuit, first and second switching contacts electrically connected to a pair of terminals of the high voltage generating circuit to control the spark discharge at the spark gap, a first actuator for operating the first switching contact in relation to the second switching contact, the first and second switching contacts being arranged moveable relative to each other to effect operation of the high voltage generating circuit, and a second actuator arranged to control the movement of the second switching contact between its operative position where it can contact the first switching contact through operation of the first actuator and its inoperative position where it is maintained not to contact the first switching contact.

2. A lighter as claimed in claim 1 wherein the first and second switching contacts are operable through the first and second actuators independently of each other at an optional time interval.

3. A lighter as claimed in claim 2 wherein the movement of the first switching contact is effected in the horizontal direction relative to the lighter and that the second switching contact is in the vertical direction.

4. A lighter as claimed in claim 2 wherein the first actuator comprises a manual operator which is reciprocably arranged on the side wall of the casing so that the movement of the first switching contact is effected by the reciprocal movment of the manual operator.

5. A lighter as claimed in claim 2 further comprising a lighter lid arranged on the casing, an intermediary means moveably arranged between the lighter lid and the valve control means, the second actuator comprising the intermediary means, the movement of the second switching contact being effected through the intermediary means in accordance with the operation of the lighter lid.

6. A lighter as claimed in claim 5 wherein the intermediary means comprise a lid control means for facilitating the operation of the lighter lid, the lid control means being pivotally moveable within the casing to define the operative and inoperative positions of the second switching contact under the operation of the lighter lid.

7. A lighter as claimed in claim 5 wherein the intermediary means is linearly moveable within the casing to define the operative and inoperative positions of the second switching contact under the operation of the lighter lid.

8. A lighter as claimed in claim 7 wherein the lighter lid is provided with a depending piece which has a curved edge to abut the intermediary means and the curved edge defines the movement of the intermediary means to determine the timing of movement to the operative position of the second switching contact.

9. A lighter as claimed in claim 7 further comprising a guiding pin for slidably guiding the valve control means, the intermediary means being arranged to be slidable along the guiding pin.

10. A lighter as claimed in claim 5 wherein the operative position of the second switching contact is defined by the opened state of the lighter lid and the inoperative position thereof is defined by the closed state of the lighter lid.

11. A lighter as claimed in claim 4 wherein the first switching contact is disposed on the manual operator which is electrically connected to one terminal of the high voltage generating circuit and the second switching contact is disposed on the valve control means which is electrically connected to the other terminal of the high voltage generating circuit.

12. A lighter as claimed in claim 11 wherein the manual operator is provided with a depressed portion to prevent contact between the first and second switching contacts in the inoperative position of the latter.

13. lighter light as claimed in claim 11 wherein the manual operator has disposed therein an electrically insulated member to prevent electric connection between the first and second switching contacts in the inoperative position of the latter.

14. A lighter as claimed in claim 11 further comprising a pin for slidably guiding the valve control means, electrically conductive spring means arranged around the pin to bias the valve control means toward the operative position thereof, the valve control means being electrically connected through the spring means to the other terminal of the high voltage generating circuit.

15. A lighter as claimed in claim 14 further comprising an electrically conductive means disposed adjacent to the pin and in electrical connection with the other terminal of the high voltage generating circuit, and an electrically conductive cover member arranged on the pin and in electrical connection with the valve control means, the conductive means being immoveably fixed by the cover member in tight contact therewith to assure the electrical connection between the valve control means and the other terminal of the high voltage generating circuit.

16. A lighter as claimed in claim 14 wherein the spring means comprises an elastic plate and a coiled spring, the elastic plate having a first branch which abuts the valve control means to bias the latter to its operative position and a second branch which contacts the other terminal of the high voltage generating circuit, the coiled spring being arranged between the first and second branches of the elastic plate.

17. A lighter as claimed in claim 14 wherein the valve control means whose one end is supported on the pin is engaged at the other end thereof with the burner valve to control the latter, the burner valve comprising a fuel discharge nozzle which is electrically insulated from the valve control means and electrically connected to the secondary side of the high voltage generating circuit.

18. A lighter as claimed in claim 17 further comprising an electrically conductive disc connected to the secondary side of the high voltage generating circuit, the conductive disc being arranged on the nozzle and biassed by a spring arranged around the nozzle to assure a fixed contact relation with the nozzle.

19. A lighter as claimed in claim 11 further comprising a support member for components of the high voltage generating circuit, the support member being provided with an extending wall on which are arranged a guide for reciprocal movement of the manual operator and a spring means for biassing the manual operator to its inoperative position, the manual operator being electrically connected through the spring means to one terminal of the high voltage generating circuit.

20. A lighter as claimed in claim 11 wherein the fuel reservoir has arranged thereon an electrically conductive means having an elastic piece to abut the manual operator, the manual operator being electrically connected through the conductive means to one terminal of the high voltage generating circuit.

21. A lighter as claimed in claim 19 wherein the support member is also provided with a downwardly extending wall on which is arranged a terminal plate connected to one terminal of the high voltage generating circuit, an elastic means of electric conductivity is arranged in opposition to the terminal plate of the downwardly extending wall to hold the power supply source therebetween, the elastic means being electrically connected to the manual operator.

22. A lighter as claimed in claim 21 wherein the elastic means comprises an elastic contact piece to contact one pole of the power supply source and a biassing spring arranged behind the contact piece to bias the latter against the one pole of the supply source.

23. A lighter as claimed in claim 22 further comprising a bottom plate of the casing provided with an opening for inserting and removing therethrough the power supply source, a detachable cap for shutting the opening, the detachable cap having arranged therein a horizontal recess in which a moveable plate is arranged for setting the detachable cap on the inner wall of the casing.

24. A lighter as claimed in claim 23 wherein the detachable cap has a hole in which a pin is inserted through the moveable plate, the pin having a tapered portion adapted to engage the moveable plate to effect sliding movement of the latter.

25. A lighter as claimed in claim 24 wherein the detachable cap has a hole in which a pin is inserted through the moveable plate, a spring is arranged in the horizontal recess to bias the moveable plate against the adjacent inner wall of the casing, the pin having an eccentric cam shaft to engage the moveable plate to effect the sliding movement of the latter under the force of the spring.

* * * * *

UNITED STATES PATENT AND TRADEMARK OFFICE

CERTIFICATE OF CORRECTION

PATENT NO. : 4,022,566

DATED : May 10, 1977

INVENTOR(S) : Kenjiro Goto

It is certified that error appears in the above-identified patent and that said Letters Patent are hereby corrected as shown below:

Column 1, line 21, delete "theoperation" and insert therefor --the operation--.

Column 4, line 56, delete "a diode ac" and insert therefor --a diode 9c--.

Claim 21, delete "terminal plate of the downwardly" and insert therefor --terminal plate on the downwardly--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*